US005498100A

United States Patent [19]

Guernsey

[11] Patent Number: 5,498,100

[45] Date of Patent: Mar. 12, 1996

[54] RETRACTABLE DELINEATOR SYSTEM FOR SUSPENSION SPAN & TRUSS BRIDGES

[76] Inventor: Robert M. Guernsey, 46 Elm Ave., San Anselmo, Calif. 94960

[21] Appl. No.: 329,008

[22] Filed: Oct. 7, 1994

[51] Int. Cl.[6] ..... E01F 13/00

[52] U.S. Cl. ..... 404/6; 404/9

[58] Field of Search ..... 404/6, 9, 11; 49/49; 256/13.1

[56] References Cited

U.S. PATENT DOCUMENTS

| | | | |
|---|---|---|---|
| 4,503,423 | 3/1985 | Mainiero | 340/552 |
| 4,576,508 | 3/1986 | Dickinson | 404/9 X |
| 4,844,420 | 7/1989 | Oster | 256/1 |
| 5,072,980 | 12/1991 | Mainiers | 294/15 |
| 5,158,584 | 12/1992 | Tamura . | |
| 5,181,695 | 1/1993 | Arthur | 256/13.1 |

*Primary Examiner*—William P. Neuder

*Attorney, Agent, or Firm*—Phillips, Moore, Lempio & Finley

[57] ABSTRACT

A barrier system which provides a new and unique approach to separating traffic and provides a safe, convenient and effective means of controlling traffic. Segmented continuous interlocking barriers embedded in the roadway rise out of the roadway to prevent head-on collisions between opposing lanes of traffic to aid in the prevention of serious accidents and loss of life on any undivided roadway on a suspension or truss bridge. All electro-mechanical mechanisms are controlled by PLC programmable controllers, automation software and a data processor control system link with mobile end-system wireless link compatibles in a multi-capability environment to perform the electro-mechanical tasks in altering traffic lane configurations. A set performance schedule is set up according to traffic flow by user in the alternating of its mechanical barrier devices in sequential order, with means from pneumatic air cylinders. The system is provided with a protective ground motion seismic sensor device in the safety circuits.

5 Claims, 12 Drawing Sheets

Fig 9
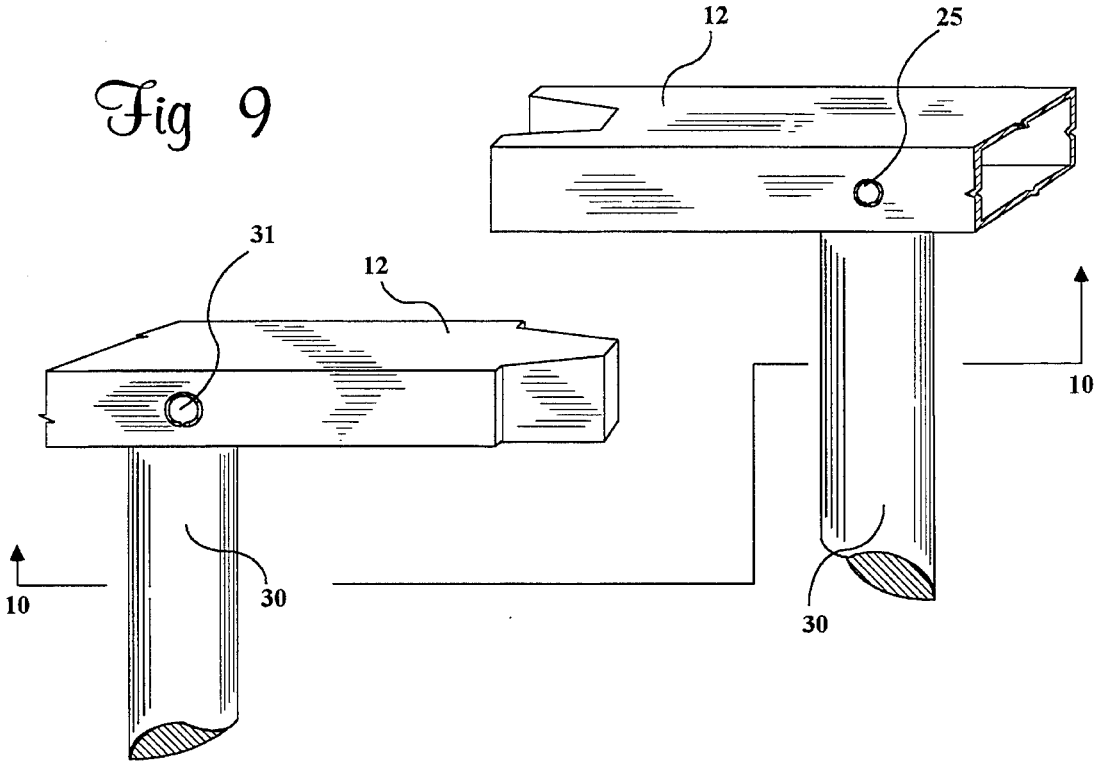
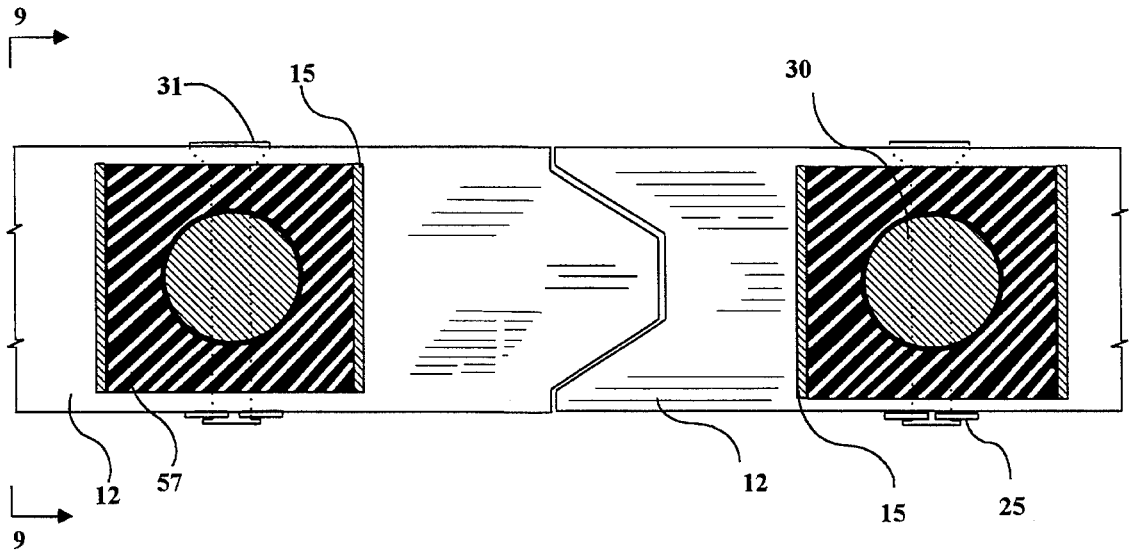
Fig 10

RETRACTABLE DELINEATOR SYSTEM FOR SUSPENSION SPAN & TRUSS BRIDGES

FIELD OF INVENTION

This invention relates to a movable median barrier in general and, in particular to a barrier for use on suspension span or truss bridges. The barriers act to alternate the center divider line separating (delineating) opposite directions of traffic on the same road surface, with aid from vertical mounted air pneumatic cylinders and horizontally mounted structural steel tubing.

These barriers can increase the bridge's capacity during commute hours. By controlling the flow of the number of lanes of traffic in a given direction, the barriers can alter the lanes used for peak hours of commute traffic and the aid in preventing vehicles from crossing into the opposing lanes of traffic and thereby preventing head-on collisions.

A barrier system of this type, must be fixed to the underside steel framework structure of a bridge and deck surface. All cylinders supporting the barrier rail pass through the bridge steel ribs, deck plate, and applied road surface and are supported from the under structure of the bridge.

This system has several electro-mechanical mechanisms, which energize pneumatic air rods to be fully extended and/or be fully retracted into the road surface.

A painted line of reflector paint will be placed on the top and the sides of the rectangular steel tubes (barrier rail) affixed to the pneumatic rods. When not in use the retractable delineator system's rectangular steel tubes will act as a painted line on the road surface, to divide lanes of traffic.

Most bridges do not offer any margin of safety or any kind of barrier system that could prevent head-on collisions. Occasionally when there is no barrier in place, the lanes are painted with a double yellow line or a broken white line with raised pavement markers, or plastic cones are use to separate lanes and/or divert traffic.

Existing suspension span and truss bridges which have been in existence for many years have only limited space for installation of any prior art lane barriers. Suspension span and truss bridges needing a median barrier to separate opposite directions of traffic on the roadways could use a barrier system of this type.

BACKGROUND DESCRIPTION OF PRIOR ART

Barriers fall into several types of categories: movable median barriers, permanent barriers, concrete median barriers, Quickchange Moveable Barrier (QMB) Systems, and some temporary barriers systems like movable median barrier systems, Polyethylene PVC pylons, delineator median systems, and energy absorbing medians. Barriers systems in general need a minimum of twelve feet to fourteen feet per lane to maintain lane width to adapt the use of prior art barrier systems on a suspension span bridges, truss bridges, or overpasses.

The disadvantages of these types of systems are that permanent median barriers and movable median barriers take up critical and limited lane space on the bridge road surfaces. Wide barriers create smaller lanes, which cause adjoining vehicles to be closer to one another, creating hazardous situations where the small clearance between lanes increase the danger of contact and collision between adjoining vehicles.

Movable median barriers are complex, sometimes difficult to use on existing bridge roads, and time consuming to move when attempting to complete the task of changing lanes.

Delineators cones used today are of a molded polyethylene and/or PVC plastic, in cylindrical form, with colors added to the plastic, and reflector tape wrapped at the top edge. They are designed to warn vehicles of the presence of an opposing lane of traffic. They are usually not used to divert the flow of traffic to one side of a given lane.

Delineator pylons used on suspension span bridges today do not provide a safety margin as far as preventing a head-on collisions. On bridges where opposing traffic flow is on one road surface, this lack of safety margin is a constant problem. A work crew changing the location of pylons by hand while driving across a bridge is also at risk. Handling the pylons by hand is potentially very dangerous to the driver of the vehicle and its occupants, not to mention that such a slow moving vehicle could easily be accidentally misdirected so that it abruptly swerve into the opposing lane of traffic to potentially cause a head-on collision during this process.

SUMMARY OF INVENTION

Some submitted drawing figures are based on scaled drawings from the Golden Gate Bridge, Highway and Transportation District, these drawings depict this bridge that spans the Golden Gate located between the counties of San Francisco and Marin, in Calif. at the mouth of the San Francisco Bay.

Unlike the prior art in a retractable delineator system, according to the present invention the delineator rail will only take up, six to eight inches in width of the center divider line for the installation of this system on existing suspension span and/or truss bridges.

Problems of the prior art can be solved by embedding a galvanized steel rectangular tube barrier in a road surface of an undivided bridge. The new advantages include a barrier member connected to and supported by a pneumatic cylinder rod and fixed to the road surface. The barrier system uses a horizontal galvanized steel rectangular tube (barrier member) fixed to the rod end which allows the system to have several operating modes. Components of the barrier system are configured to retract into the road surface and others components are configured to be mounted under the steel framework of the bridge deck.

In one embodiment the retractable barrier member is controlled by a computer control system to change the location of a barrier for any given lane. The number of lanes in one direction can be increased or decreased by altering which barrier wall is elevated. The work crews can effectively guard the movement of the barrier while driving in a safe manor across the bridge, while preventing vehicles traveling on the bridge from crossing the barrier in use or about to be used.

BRIEF DESCRIPTION OF THE DRAWINGS

FIG. 9 shows a perspective view of the connection between two rectangular tube 12 sections, and shows the male-female ends of each section of 12;

FIG. 10 shows a bottom cross sectional view of the connection between the pneumatic rod 30 and the rectangular tube 12 between two sections, also the male-female ends of each section of 12;

DETAILED DESCRIPTION

Figure 1:
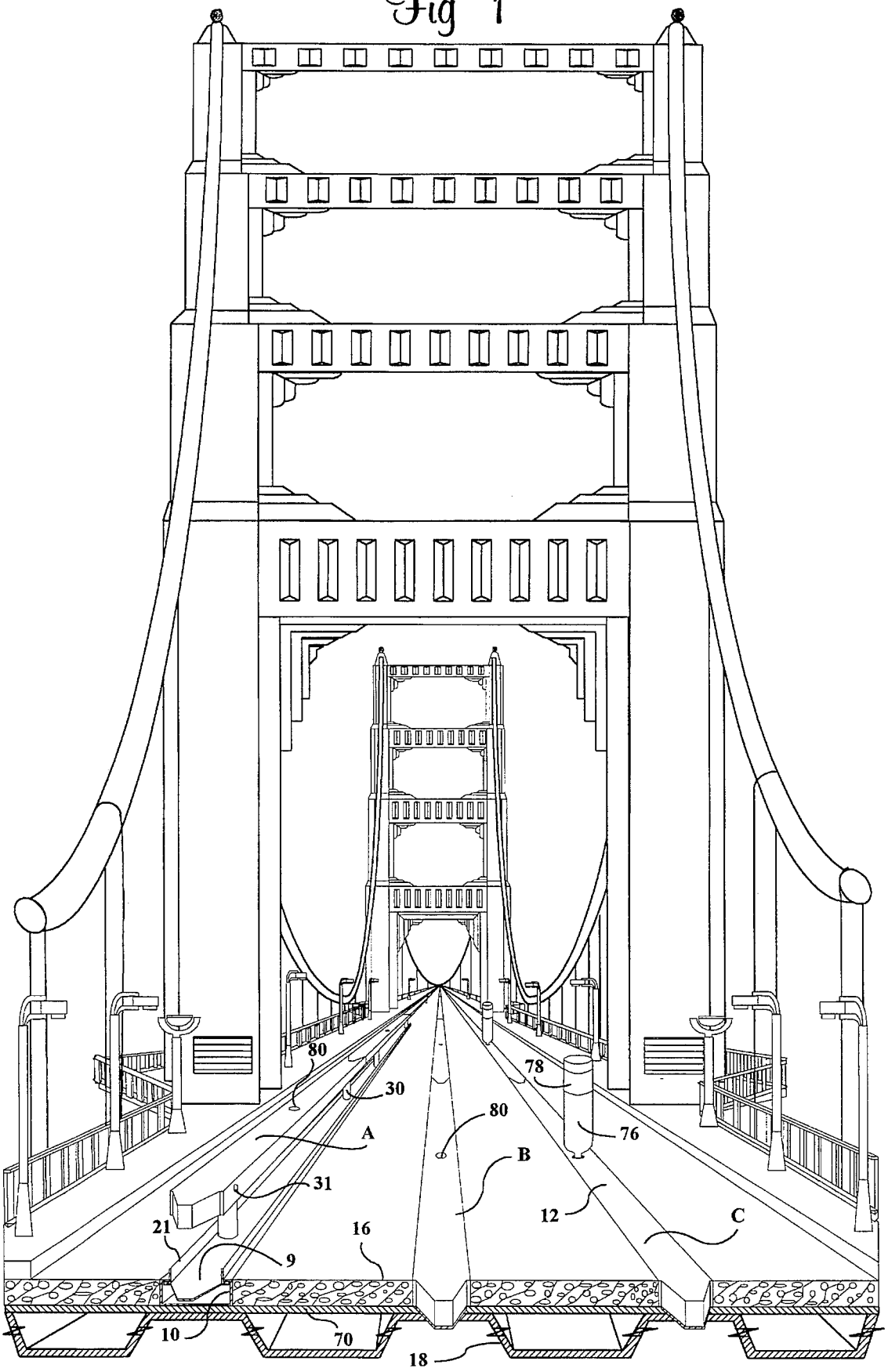
FIG. 1 is an end perspective view of a four-lane bridge showing, in use therein, an embodiment according to the invention.

FIG. 1 shows a perspective of the bridge roadway surface 16 and two divided lanes for controlling traffic. The retractable delineator system 12, preferably made of galvanized steel, is shown in several operational positions. The system shown at the right in the Figure labeled C is shown retracted into the road surface 16, and a plastic pylon 76 with reflector tape 78 wrapped at the top edge, is put into hole 80 through deck plate 70, through steel rib 18, into a lined hole of 80*a*.

The retractable delineator system shown in the middle of the Figure labeled B is shown descending into the roadway surface 16, where it acts as the white line in road surface 16. The retractable delineator system at the left side of the Figure labeled A is shown in its fullest extended raised position from the roadway surface 16, the tube 12 rising from the roadway and supported by the pneumatic rods 30. The center barrier shown in FIG. 1 shows retraction of the barrier. When situated in the roadway, as shown in the right side of FIG. 1, the rectangular tubing receiving a male of female end on adjacent rectangular barrier sections 12 interlock to form a continuous smooth barrier and a continuous roadway surface.

The extension of a series of aligned barrier member sections or rectangular barrier tubes 12, which interlock with one another by means of a male end and a female end to form a continuous barrier between adjacent lanes. The interlocking of these pieces when the barrier is fully extended and retracted provides additional strengthening and prevents breach of the barrier at the points of mating.

Figure 2:
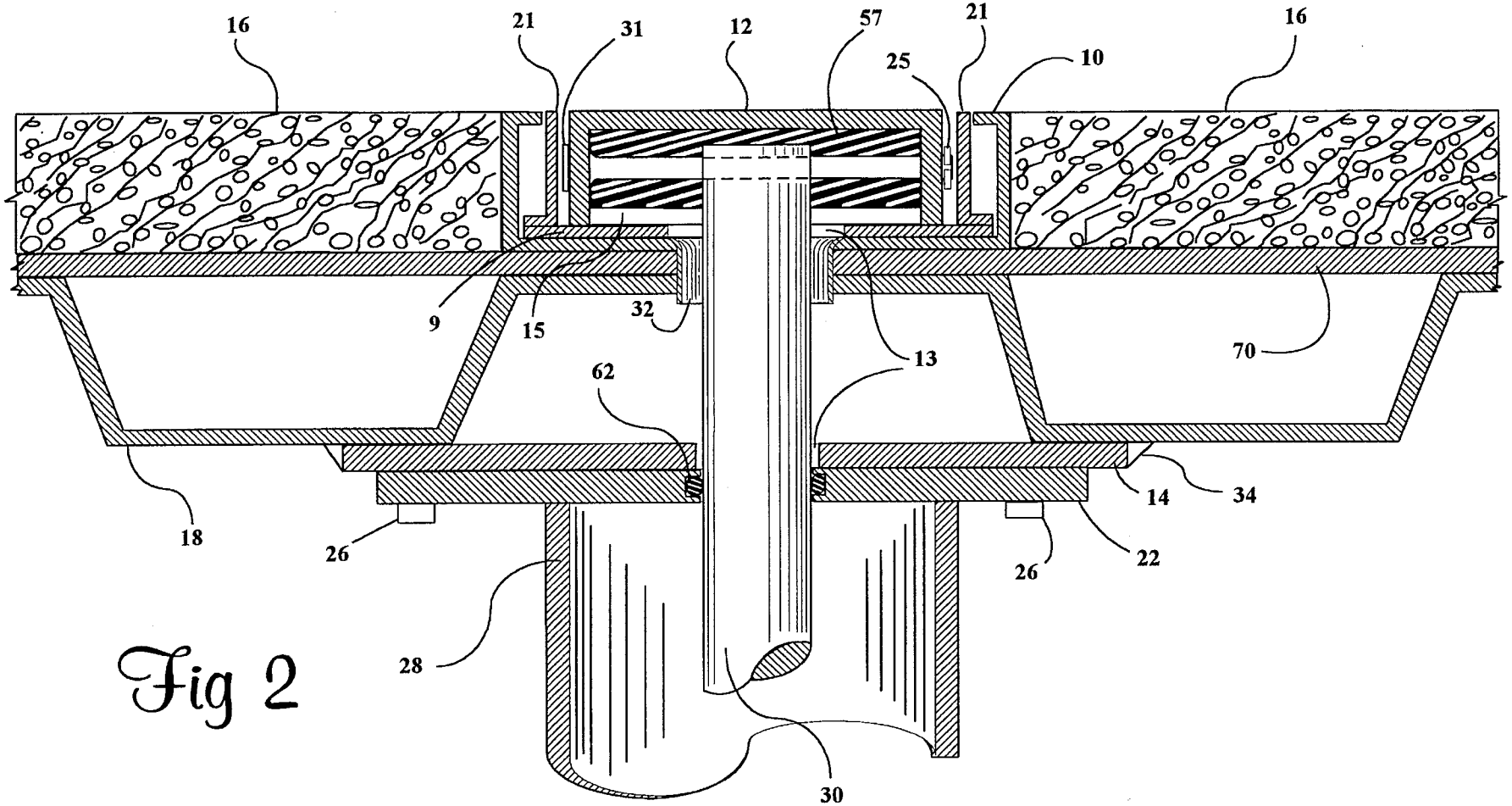
FIG. 2 shows a cross section of the bridge roadway at the center of a lifting ram with the roadway barrier according to the invention retracted into the roadway.

FIG. 2 shows a cross sectional view of the invention installed in a roadway and retracted so that the top of rectangular tube 12, preferably made of galvanized steel, is in line with the top of roadway surface 16. The barrier assembly includes a channel for receiving both the rectangular barrier tube 12 and the safety lock cover 9 preferably made of galvanized steel, which supports a trash guard plate 21, preferably made of galvanized steel.

When fully retracted the barrier assembly provides a top surface matching the elevation of the adjacent roadway surface, with only a small gap between the edge of the rectangular tube 12 and the side of the trash guard plate 21.

The galvanized rectangular tube 12 has a molded rubber piece 57, preferably made of soft rubber, within the tube 12 and surrounding each rod 30 to hold the rectangular tube 12 in a centered position on the pneumatic rod 30. The pneumatic rod 30 is connected to rectangular tube 12 by a pneumatic rod lock pin secured by a snap ring 25. In the retracted position, as shown in FIG. 2, the rectangular barrier tube 12 is in contact with the safety lock cover 9 and holds it retracted below the roadway surface.

The pneumatic rod 30 extends from a pneumatic cylinder 28 mounted below the roadway surface 16 and within the bridge substructure (e.g., a deck plate over steel ribbing 70, and steel ribbing of deck plate 18, welded mounting plate 14, flange mounting bracket 22, and mounting bolts 26).

Figure 3:
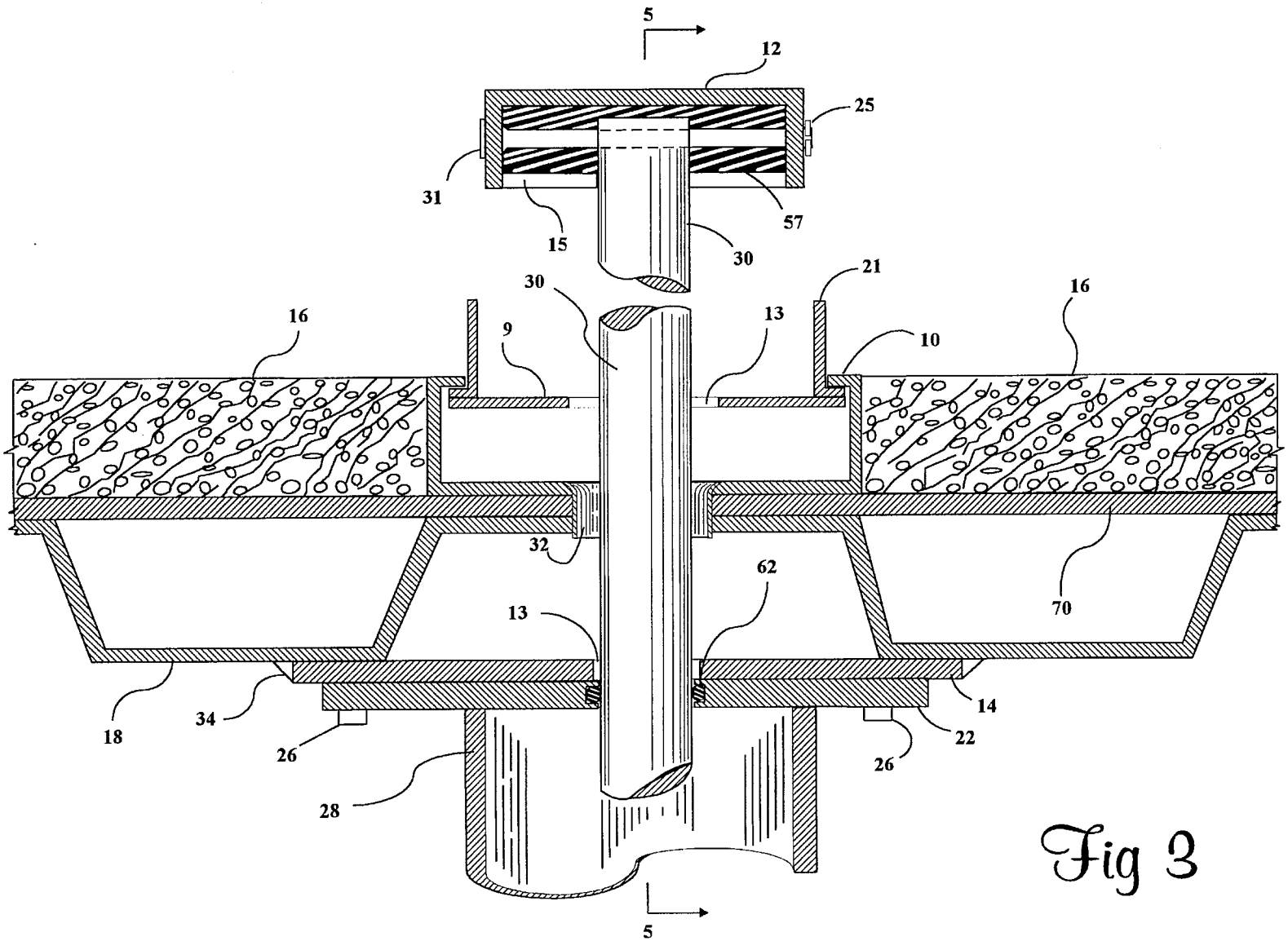
FIG. 3 shows a cross section of FIG. 2 with the lane delineator (barrier) in a raised position.

FIG. 3 shows the barrier assembly according to the invention as shown in FIG. 2, but extended to form a barrier. In addition to the rectangular barrier tube 12 having been raised by the pneumatic rod 30, the safety lock cover 9 and its connected trash guard plates 21 are also extended above the roadway to prevent roadway debris from easily rolling or falling off the roadway surface into the space under the rectangular barrier tube 12. The safety lock cover 9 is supported by springs (not shown in FIGS. 2 or 3) which hold the plate in its extended position. When the rectangular barrier tube 12 is retracted by the pneumatic rod 30, the rod and tube assembly place downward pressure on the safety lock cover 9 and hold it in the fully retracted position shown in FIG. 2. The bridge superstructure and roadway surface shown in FIG. 4 include three retractable delineator systems according to the invention to be used to separate six lanes (not shown in FIG. 1 & FIG. 4) of the roadway.

Figure 4:
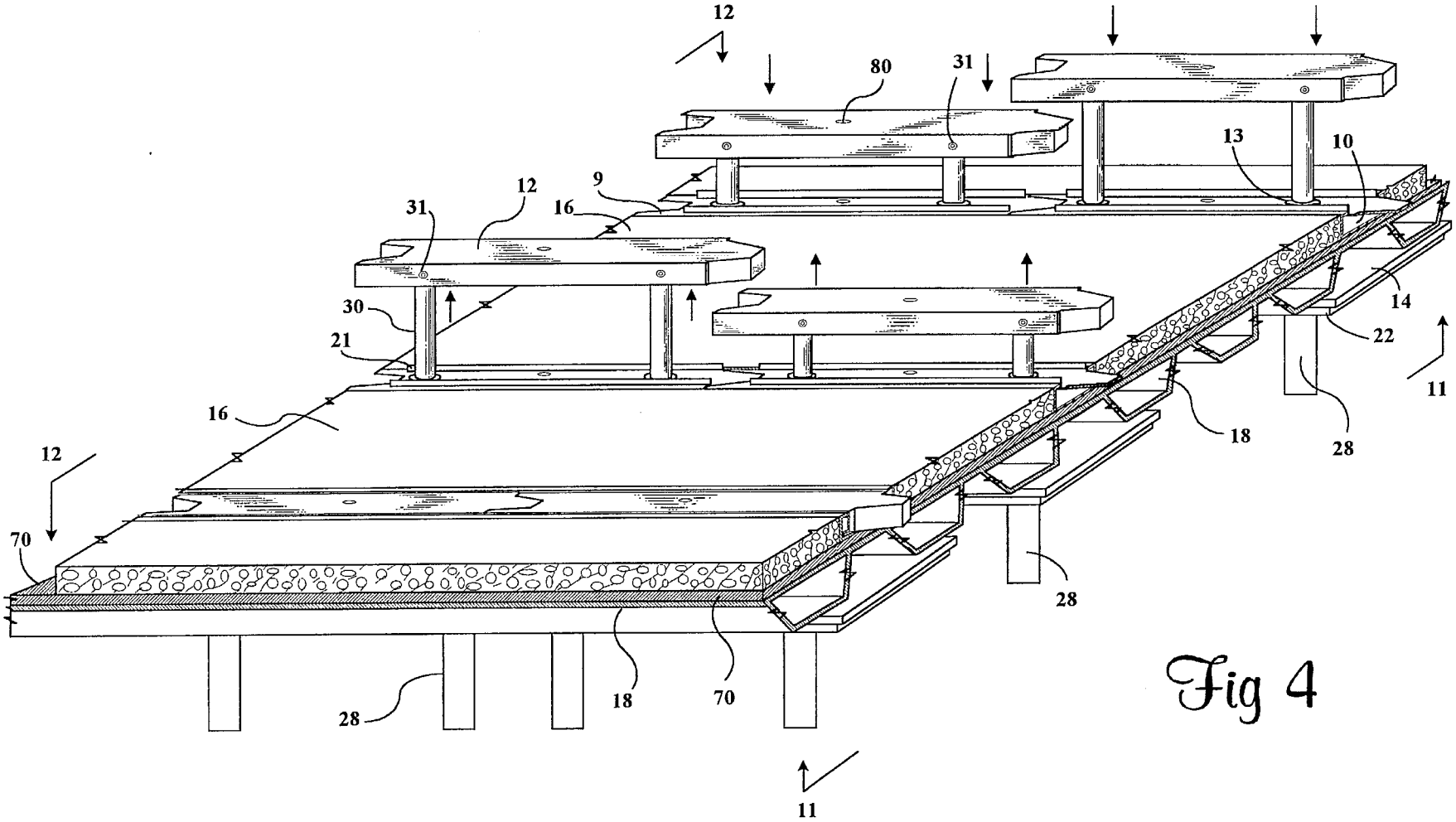
FIG. 4 shows a perspective of the bridge roadway surface showing the retractable delineator system at three operating conditions according to the invention.

FIG. 4 shows an embodiment according to the invention where the roadway delineator system is shown in several operational positions. The system shown at the left of the Figure (in the foreground) is shown retracted into the roadway. The retractable delineator system shown in the middle of the Figure is shown descending into the roadway. The retractable delineator system at the right side of the Figure is shown rising into position from the roadway.

The retractable delineator system includes a series of aligned barrier sections or rectangular barrier tubes 12 that interlock with one another by means of a male end and a female end to form a continuous barrier between adjacent lanes. These tubes 12 rise from the roadway and are supported by the pneumatic rods 30. The extension of the roadway barrier as shown at the right side of FIG. 4 shows the rectangular barrier tube 12 receiving each section with each male-female end-to-end to receive the previous section. The center barrier shown in FIG. 4 shows retraction of the barrier. Situated in the roadway, as shown in the left side of FIG. 4, the rectangular tubing receives a male or female-end on adjacent rectangular barrier sections 12 and interlocks to form a continuous barrier and roadway surface. The interlocking of these pieces when the barrier is fully extended or retracted provides additional strengthening and prevents breach of the barrier at the points of mating.

Figure 5:
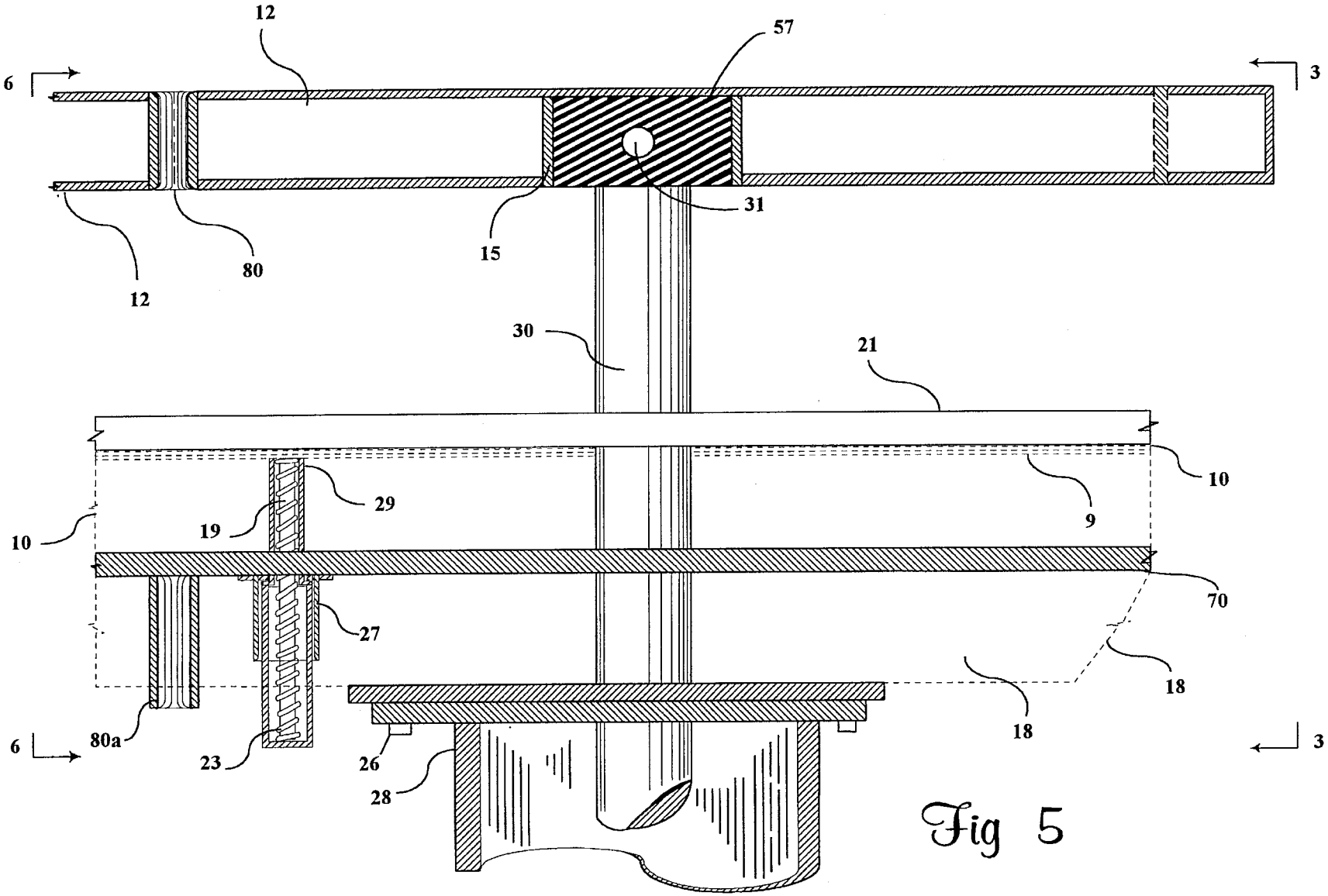
FIG. 5 shows a side cross sectional view of an embodiment of the delineator system according to the invention, viewed around the center of a pneumatic rod 30, and pneumatic cylinder 28; also shown are the spring assembly and pylon hole alignment.

FIG. 5 shows a side cross section of the pneumatic rod 30 extended from the roadway. The surface of the rectangular tube 12 includes a hole for a pylon 80 that allows delineator pylons to be placed into the roadway surface at these locations when needed (e.g., when the retractable delineator system is undergoing maintenance). The spring 23 that supports the safety lock cover 9 is shown at the lower left side of the figure. A steel rod 19 projects into a galvanized steel tube 27 contacting the spring 23 and acts as a piston inside its galvanized steel tube housing 27 to raise the safety lock cover 9. Other items shown in the view of FIG. 5 include a trash guard plate 21, channel 10 for receiving the rectangular barrier tube 12, trash guard 21, safety lock cover 9, deck plate 70, drain hole 32 (not shown in FIG. 5) to allow water to drain from the channel 10, and a pylon receiving hole 80*a* which extends the pylon receiving hole 80 shown in the rectangular barrier tube 12.

Figure 6:
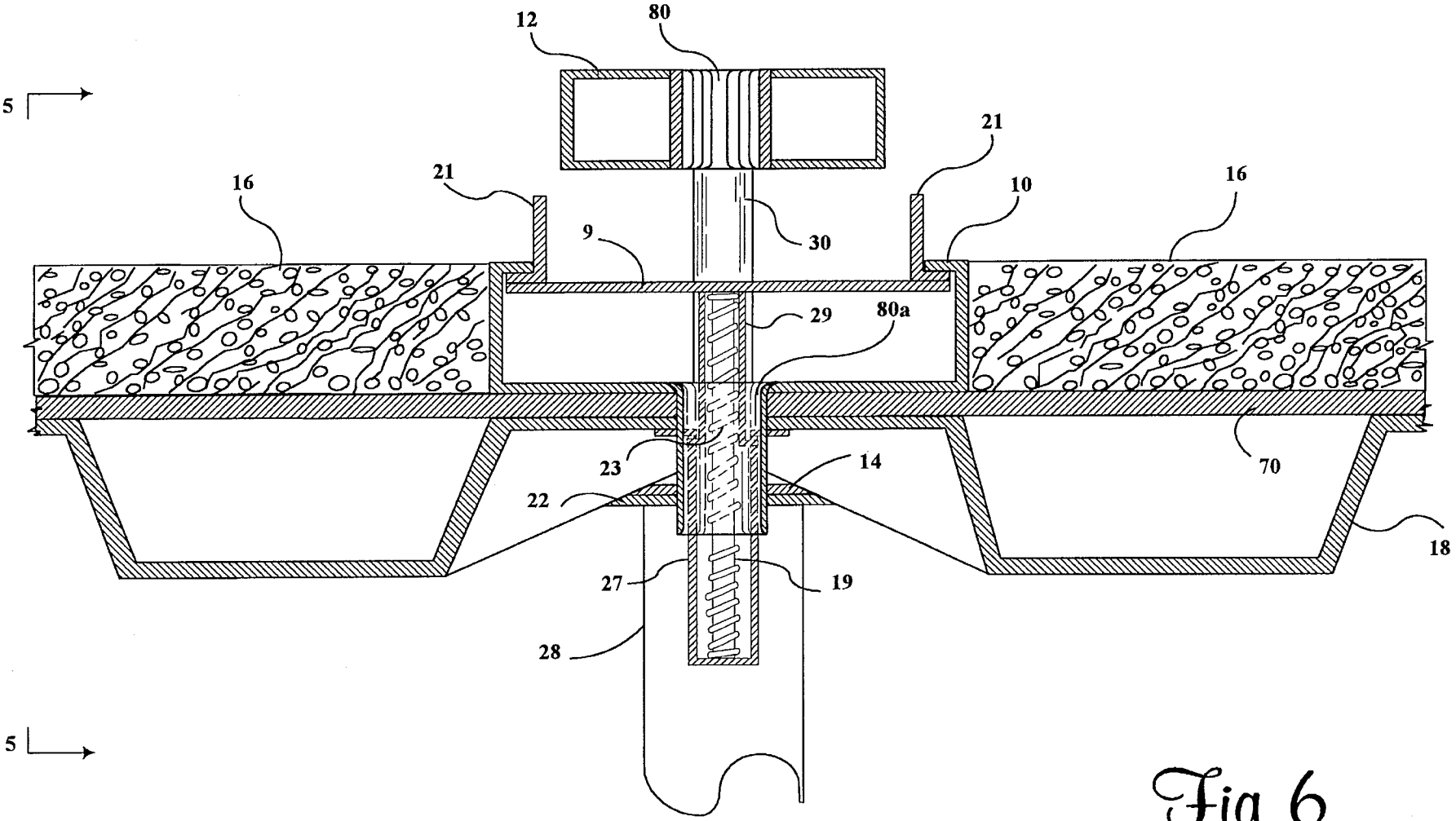
FIG. 6 shows a cross section of FIG. 3 reverse side with the lane delineator (barrier) in a raised position, showing the connection between the spring assembly, pylon, and hole according to the invention.

FIG. 6 shows a cross section with the lane delineator 12 (barrier) as it is lifting to its raised position, shows the connection between the spring 23 and the steel rod 19 which acts as a piston inside its galvanized steel housing 27; galvanized outer housing 29 having a lip at its bottom edge to hold the spring housing assembly together for raising the safety lock cover 9 assembly; plastic PVC pylon receiving hole 80 shown in the rectangular galvanized steel barrier with additional galvanized pipe placed in the steel deck plate 70 and the steel rib of 18 according to the invention. Other items shown in the view of FIG. 6 include trash guard plate 21, the channel 10 for receiving the rectangular barrier tube 12, the trash guard 21, the safety lock cover 9, the deck plate 70, a drain hole 32 (not shown in FIG. 6) to allow water to drain from the road surface through the channel 10, and a pylon receiving hole 80*a* which extends the pylon receiving hole 80 shown in the rectangular barrier tube 12.

Figure 7:
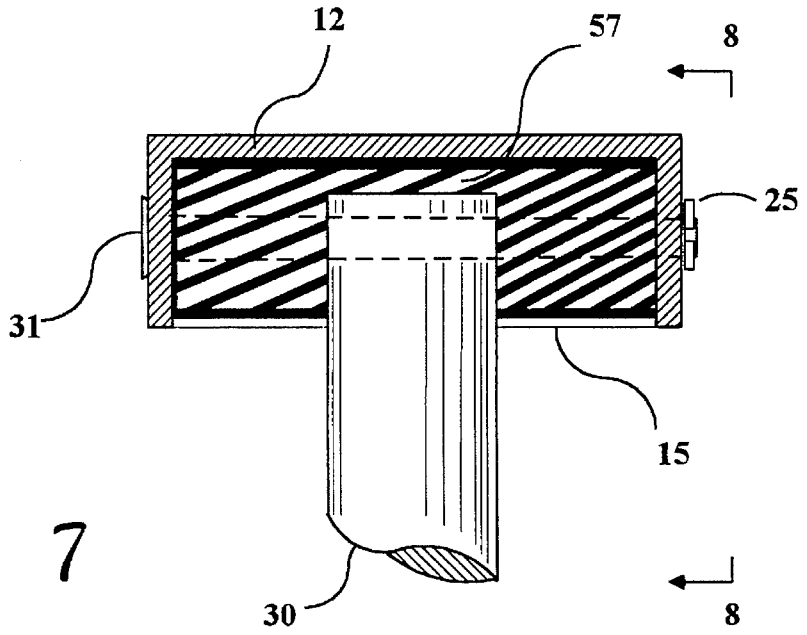
FIG. 7 shows a cross sectional end view of roadway barrier according to the invention viewed at the location of a pneumatic rod 30.

FIG. 7 shows a cross sectional end view of a roadway barrier section, in which the galvanized rectangular steel tube 12 is held intact to form a secure fit to pneumatic rod 30 by a piece of formed rubber 57 placed inside the galvanized rectangular steel tube 12. Each exposed galvanized rectangular steel tube cutout is covered with a plate 15. A galvanized steel locking pin 31 passes through galvanized rectangular tube 12, through formed rubber 57, through the pneumatic rod 28, through formed rubber 57 through galvanized rectangular tube 12, and is held with a temper steel snap ring 25.

Figure 8:
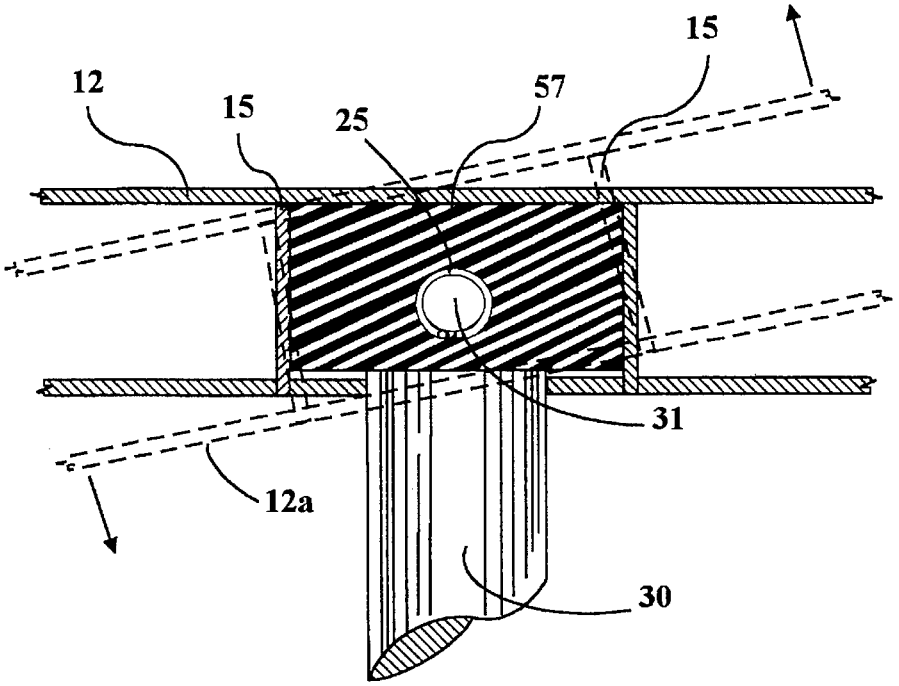
FIG. 8 shows a side cross sectional view of the connection between the pneumatic rod 30 and the rectangular tube 12.

FIG. 8 shows a side cross sectional view of the rectangular tube 12 in the raised (extended) position, the cut out section on the bottom of the rectangular tube 12 where each pneumatic rod 30 will be attached, and a galvanized steel plate 15 to seal the inside of the rectangular tube by placing the formed rubber 57 in the cut-out provided to hold the rod 30 firmly in place. The assembly is held together by the galvanized steel locking pin 31 and the snap ring 25. FIG. 8 also shows the rectangular tube 12a is not horizontal to the road surface 16; this condition or movement may occur during cycling of the system, during which the formed rubber stabilizes rod 30 so all components rise simultaneously as a unit.

FIG. 9 shows a perspective view of the connection between two rectangular rods 30 and the rectangular tube 12. The assembly is united by the galvanized steel locking pin 31 and the snap ring 25 and the rectangular tube 12 is made with a male-to-female end to enable interlocking sections.

FIG. 10 shows a bottom cross sectional view of the connection between the pneumatic rod 30 and the rectangular tube 12 between two pneumatic rod sections described in FIG. 9.

Figure 11:
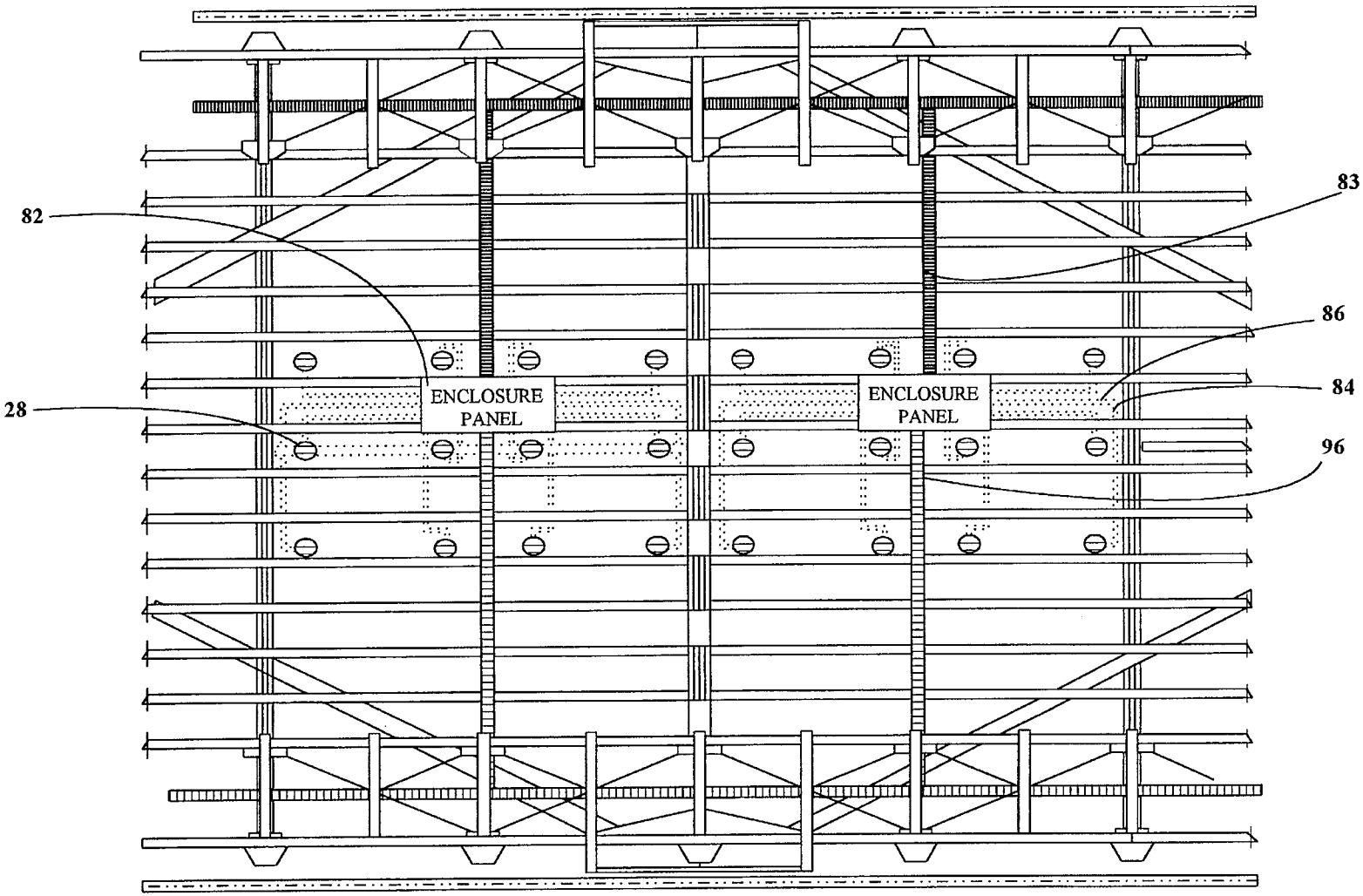
FIG. 11 shows a retractable delineator system, according to the invention, positioned in a bridge roadway as viewed from the bottom and through the structural framework on the bottom of the roadway.

FIG. 11 shows a retractable delineator system according to the invention positioned in a bridge roadway as viewed from the bottom and through the structural framework of bridge. The configuration of the pneumatic cylinder 28 and enclosure panel 82 illustrates a general layout for each section with main air supply through line 83, (air compressors not shown in FIG. 11) and electrical power supply line 96 in water tight conduit electrical pipe. Air pneumatic line 84 is used to provide air (or other gas) to energize cylinders 28 and air pneumatic line 86 allows the cylinders 28 to de-energize.

Figure 12:
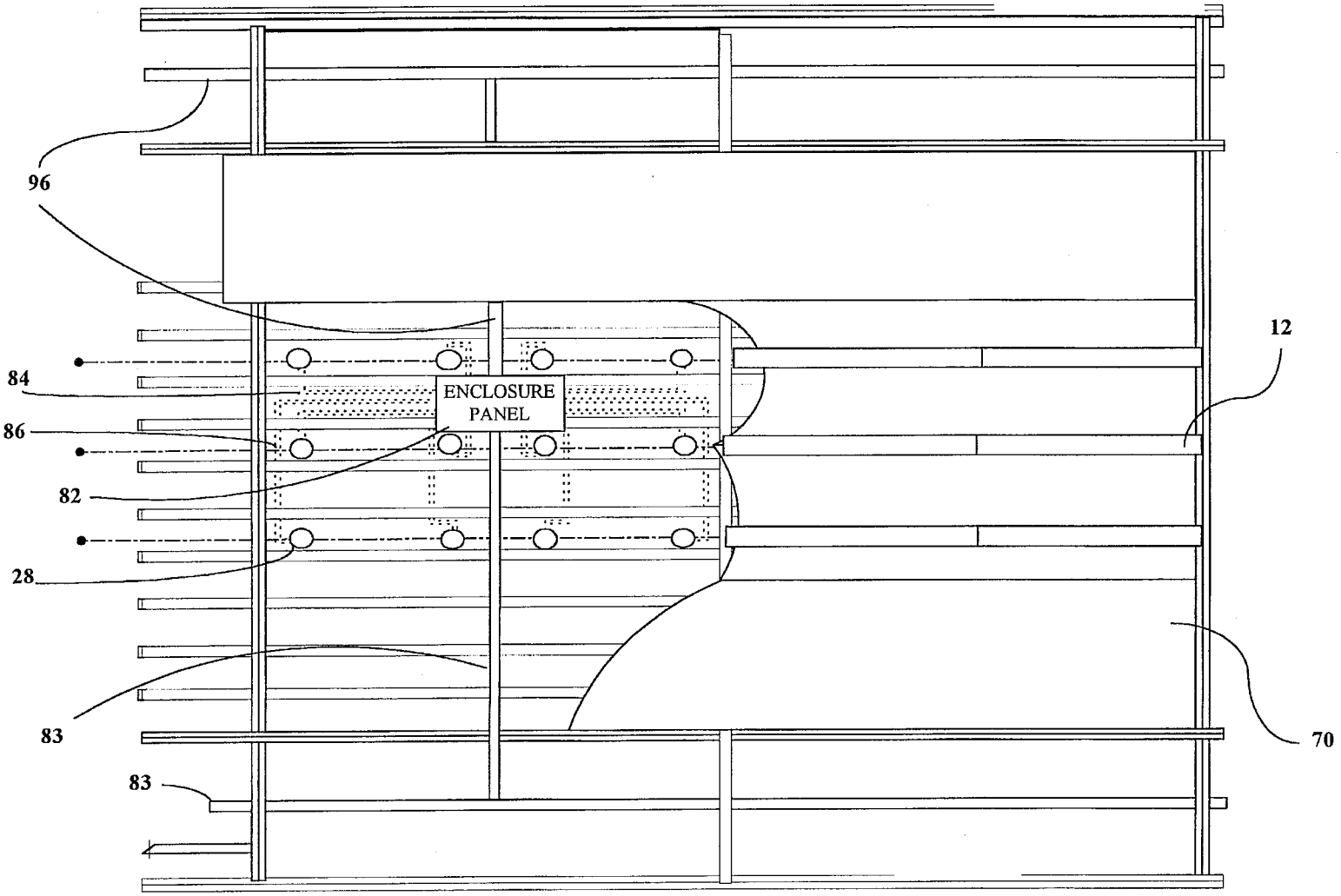
FIG. 12 shows a partial cutaway view from the roadway surface showing the retractable delineator system mounted in the roadway surface and to the structural framework viewed from the top of road surface.

FIG. 12 shows a partial cutaway view of the roadway surface showing the retractable delineator system mounted in the roadway surface, as described in FIG. 11.

Figure 13:
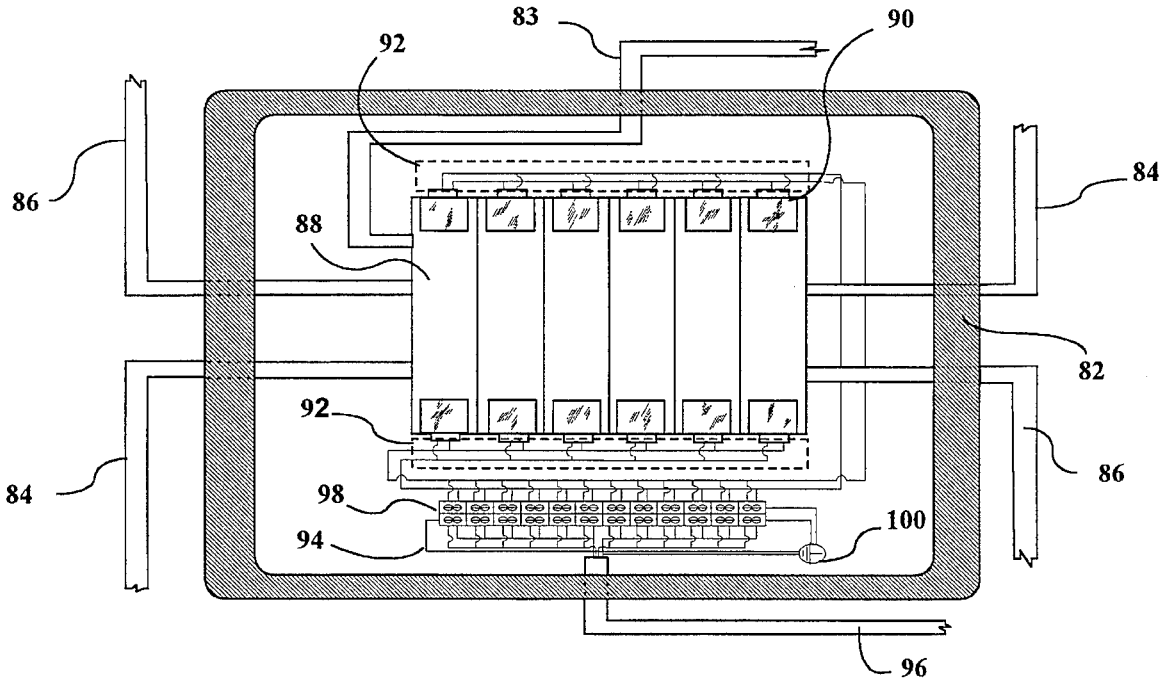
FIG. 13 shows a perspective front view of a typical enclosure panel layout according to the invention, pneumatic air-supply lines, electrical input-output wire connections supplying power to the solenoids; also included in FIG. 13 is a terminal block, wire housing assembly.

FIG. 13 shows a perspective view of a typical enclosure panel 82 layout, main pneumatic air-supply line 83, and individual air supply lines 84 and 86, providing the requisite working pressure to/from pneumatic valves 88 and electrical input-output wire connections pipe 96 to supply power to the solenoids 90. Also included in FIG. 13 is a terminal block 98 and wireway assembly 92, and wire terminal block 98 with ground-end 100 (enclosure panel covers not shown in FIG. 13).

Figure 14:
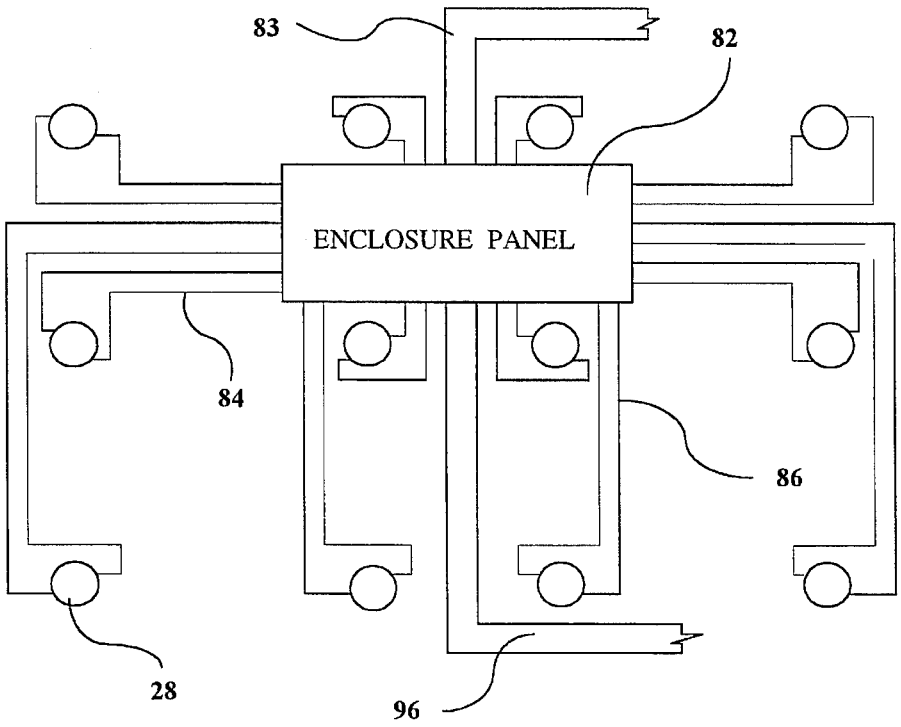
FIG. 14 shows a perspective front view layout of an enclosure panel 82 and one complete section of pneumatic cylinders 28, for controlling three individual lane devices according to the invention.

FIG. 14 shows a perspective view of one enclosure panel and a section of pneumatic cylinders 28 for controlling three individual lanes and the devices. FIG. 14 shows how air is supplied to each individual pneumatic air cylinder 28 by air supply line 84, used to energize pneumatic air cylinders 28 and supply line 86 to de- energize pneumatic cylinders also described in FIG. 13.

Figure 15:
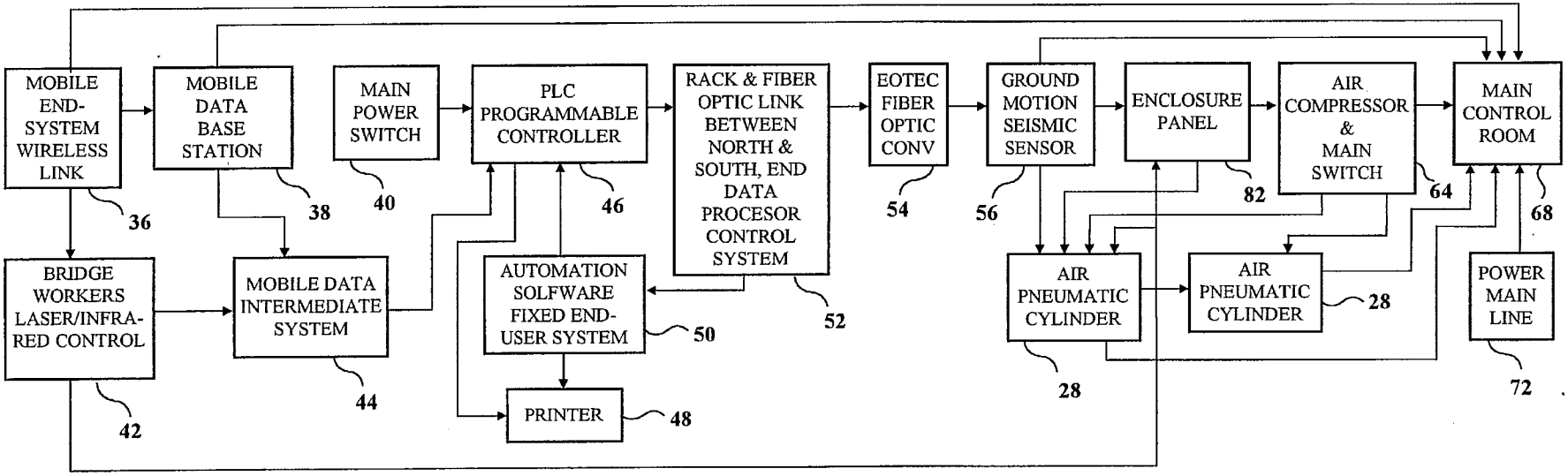
FIG. 15 shows a flow diagram chart showing the control and monitoring of a retractable delineator system according to the invention.

FIG. 15 shows a perspective of a flow chart illustrating how a road barrier system may function in an undivided road surface 16. The retractable delineator (barrier) can alternate individual divided lanes for controlling traffic in any given direction. A bridge lane-worker can control the operating cylinders 28 with a laser or infra-red electronic device 42 and a mobile end user-system wireless link 36, sending a signal to an enclosure panel 82 to energize/de-energize pneumatic air cylinders 28. Mobile data is transferred to a base station 38 and to main control room 68. Power Main Line supplied to main control room 72 is a separate power source to the bridge to operate the PLC. The main power switch 40 turned to the "on position" in Main control room 68 programmable controller 46 and the automation software fixed end-user system station 50; if needed a printer 48 will be used to view system performance and system files. The PLC controller 46 sends a set of instructions from the data processor by way of fiber optic link 52 to a command north to south end of system and data instructions from the processor are received by the EOTEC. Fiber optic converter 54 related to the enclosure panels 82 and the solenoid of each cylinder may provide instructions to several solenoids to direct air pressure supplied by air compressor 64 to pneumatic cylinders 28 to energize and de-energize a series of retractable barrier members rails cylinders so that they retract into the road surface 16 or raise up, to divide roadway surface 16.

In the preferred embodiment of this invention, The retractable delineator (barrier) system has the newest technical advantages over any system of this type, through its PLC programmable controller which enables both off-line and on-line program development. Automation software and a data processor control system, along with the computer/server base system, enable the system to be fully automatic and perform any functions with the aid of these mechanical and electrical devices. It is capable of alternating its mechanical barrier with electrical mechanisms in a sequential manner, by means of the mobile laptop/user communication end system shown in FIG. 15. This barrier system has a comprehensive package of hardware and the latest software programs to check all systems circuits throughout the system, including the computer/server system, performing all electrical/mechanical operations for this system, as well as a routine visual walk-through maintenance program. This system also includes a ground motion seismic sensor switch, a unit which will have a vertical sensor and a horizontal sensor along with a seismic switch battery backup unit.

Henceforth, the retractable delineator system, a mechanical/electrical mechanism will be called system. Said system can alter all of its mechanical devices to create the placement of the center divider line member of 12 on applied mathematics from lane placement to lane placement; similar to a movable median barrier member, but with subterranean pneumatic air cylinders mounted below the surface of a steel structure framework of a bridge or truss bridge called: retractable delineator system.

A computer automated, controlled system is used to operate several sections of pneumatic air cylinders 28 under a steel structural framework of a bridge or truss bridge. With a galvanized rectangular steel tube 12 horizontal member mounted and attached to a vertical mounted pneumatic air cylinder rod 28 from under the structural framework mounted to a galvanized steel plate 14 and flange mounted plate 22 of a bridge or truss bridge to form a barrier to control traffic.

A trench is cut into the parabolic crown of each center line that will be divided of the road surface 16 and runs in a parallel line from the given distance from each boundary condition of the road surface, as shown in FIG. 1.

This trench is cut into the crown of road surface 16 and holds the galvanized steel rectangular channel 10 having two horizontal lips turned inwards to each other. Numerous sections of said channel 10 are laid in said surface 16 to allow rod 30 from said cylinder to pass through a hole 13 cut in safety cover trash guard plate 9; said channel will be energized by a pneumatic solenoid 90 and pneumatic valve 88 enclosed in a watertight panel 82 from under the steel structure of any bridge or truss bridge and extended from north-south or east-west direction to replace the center divider line (as it is known) as shown in FIG. 4. Of said lanes to the full length of said surface 16 that will be cordoned off for the lane barrier system, this formed piece of steel channel 10 (rectangular in shape), having four right angles, two vertical dimensions and two horizontal dimensions, and being different sizes to each other, with the open side face-up in crown of surface 16, this replaces each center line that is divided by the barrier member, a flat galvanized sheet metal plate having a male-female end with hole 80 cut out so the pneumatic rod 30 can pass through the safety cover 9 that has been cut to size, with two horizontal right angles for trash guard 21 attached by a weld to said cover. This trash guard 21 is placed on top for stiffening of said cover 9 and placed inside under the horizontal lip of channel 10 of its opening to form a seal so no debris may enter channel 10 through cover 9, shown in FIG. 2., FIG. 3 and FIG. 6.

To facilitate cover 9 while galvanized rectangular tube 12 (barrier member) is being energized to the extended position from road surface 16, the cover is vertically lifted into the comers of each right angle by means of a spring assembly, inside channel 10 and closing off its opening around channel 10, a piston 19 and spring (steel) 23 are enclosed by 27, 29 outer case. This assembly is placed under said cover 9 at several points along the cover 9. The cover of trash guard 21 along surface of 16 will prevent material from jamming the said channel 10 and said cover (trash guard) 9, forms a seal at the horizontal lip of the channel 10, as shown in FIGS. 5 & 6.

The rectangular tube 12 member is affixed atop the rod 30 by means of a pin 31 and a snap ring 25 with a male-female end, one male-end on one end, and one female-end on the other end of each said rectangular tube 12 to interlock with the next section of 12; it is parallel to said surface 16 and aligned in a tandem longitude manner in its raised passion by which all said tubes 12 are interlocked together in a uniform manor to separate opposing lanes of traffic flow on a suspension span bridge or a truss bridge overpass surface.

The retractable delineator system, and its mechanical devices 12, 28, 30, 64, along with the electrical mechanisms 36, 38, 40, 42, 44, 46, 50, 52, 54, 56, 88, 90, shown in FIG. 15, can alter a given number of lanes from the outside boundary line on the bridge's parabolic crown surface of the deck road surface 16 for controlling the flow of traffic in any given direction during the peak hours of commute or at any time desired.

This system can be suitable and feasible if the manufacturer pre-installs the vertical subterranean mounted air pneumatic cylinders 28 during the prefabrication of these bridge deck sections while under construction at the manufacturing plant for suspension span bridge sections or truss bridge overpass sections.

The installation is suitable on any suspension span bridge or truss bridge overpass requiring a median system to separate and control the flow of traffic on the roadway, with a minimization of allowable space available.

While the invention has been described with regards to specific embodiments, those skilled in the art will recognize that changes can be made in form and detail without departing from the spirit and scope of this invention.

I claim:

1. A delineator system comprising:

a barrier member connected to and supported on a set of lifting ram units which are fixed in a road surface of a roadway, wherein said barrier member is a beam supported between a set of at least two of said set of lifting ram units, wherein when said ram units are extended said barrier member prevents vehicles traveling on said roadway from passing between a set of at least two of said set of lifting ram units from one side of said barrier member to a second side of said barrier member, wherein when said ram units are retracted said barrier member is also retracted into a recess in said roadway such that a top of said barrier member forms part of said road surface across which vehicles may travel.

2. A roadway delineator system comprising a plurality of delineator systems as recited in claim 1:

wherein each delineator system is disposed to separate one vehicle lane from another vehicle lane on said roadway.

3. A delineator system as in claim 1:

wherein movement of said barrier member is controlled by a computer control system.

4. A delineator system as in claim 1:

wherein when movement of the structural framework of a bridge attached to said roadway struck by earthquake activates a ground motion seismic sensor switch to shutdown any future cycling of said system and all electrical controllers are shut down preventing the barrier members from moving until reset.

5. A delineator system as in claim 1, wherein said barrier member includes a series of adjoining segments includes interlocking male-female connections which when engaged form a joint at adjoining ends of said segments, said connections resisting both compressive and tensile forces which tend to clamp or separate adjoining segments.

* * * * *